US006565780B2

(12) United States Patent
Haas

(10) Patent No.: US 6,565,780 B2
(45) Date of Patent: May 20, 2003

(54) METHOD FOR THE CONTINUOUS PRODUCTION OF ORGANICALLY BONDED BOARDS OF LIGNEOUS MATERIAL

(75) Inventor: Gernot von Haas, Leimen (DE)

(73) Assignee: Maschinenfabrik J. Dieffenbacher GmbH & Co., Eppingen (DE)

( * ) Notice: Subject to any disclaimer, the term of this patent is extended or adjusted under 35 U.S.C. 154(b) by 102 days.

(21) Appl. No.: 09/776,693

(22) Filed: Feb. 6, 2001

(65) Prior Publication Data

US 2001/0050445 A1 Dec. 13, 2001

(30) Foreign Application Priority Data

Feb. 6, 2000 (DE) ..... 100 05 251

(51) Int. Cl.[7] ..... B29C 35/16; B29C 59/00

(52) U.S. Cl. ..... 264/40.1; 264/40.4; 264/118; 264/129; 264/145; 264/157; 264/160; 264/161; 264/162; 264/172.11; 264/237; 264/348

(58) Field of Search ..... 264/40.1, 40.4, 264/161, 162, 118, 129, 145, 157, 160, 172.11, 232, 237, 348

(56) References Cited

U.S. PATENT DOCUMENTS 5,643,376 A * 7/1997 Gerhardt ..... 156/62.2

6,074,193 A * 6/2000 Kratky et al. ..... 425/371

FOREIGN PATENT DOCUMENTS

DE 199 19 822 11/2000

* cited by examiner

*Primary Examiner*—Stephen J. Lechert, Jr.
(74) *Attorney, Agent, or Firm*—Foley & Lardner

(57) ABSTRACT

A method is provided for making ligneous material boards into an endless board strand with a continuously operating press. The press includes two flexible endless steel belts which take the press material between them and carry it through the press. The steel belts thrust with friction-reducing elements against heated press plates of the press table and press ram and a cooling system that follows. The cooling system is configured as a double-belt holding apparatus with an applicable holding pressure up to a maximum of 0 to 0.05 N/mm$^2$. A diagonal sawing apparatus, which is disposed directly behind the continuously operating press and ahead of the cooling system, divides the board strand into single boards. Several rows of coolant spray nozzles disposed on the backs of the holding belts making contact with the single boards.

7 Claims, 1 Drawing Sheet

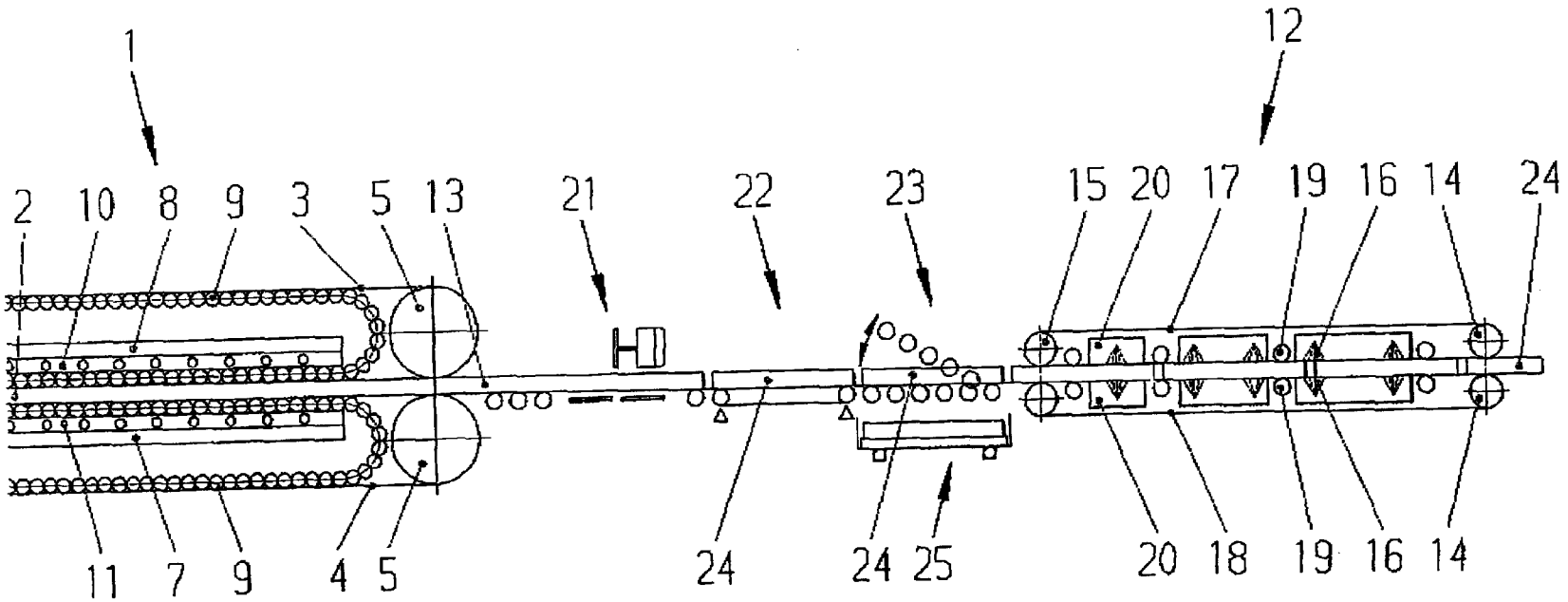
1
2
3
4
5
5
7
8
9
9
10
11
12
13
14
14
15
16
16
17
18
19
19
20
20
21
22
23
24
24
24
25

METHOD FOR THE CONTINUOUS PRODUCTION OF ORGANICALLY BONDED BOARDS OF LIGNEOUS MATERIAL

BACKGROUND OF THE INVENTION

The invention relates to a method for the continuous production of boards of ligneous material and an apparatus for the practice of the method. The term "ligneous material boards" includes chipboards, fiber boards, plastic boards and flake boards as well as plastic boards made of combined portions of wood and plastic as well as plastic with and without strengthening inserts. Such a method with apparatus, from which the invention sets out, is the subject of the German patent application DE 199 19 822, filed May 1, 1999, which is hereby incorporated by reference.

The invention according to the German patent application above was addressed to the problem of conducting the process of cooling the boards after the boards are produced, so that the "hydrolysis effect" no longer occurs, distortion of the boards is prevented, and the climatization is for the most part economized.

The method of the German patent application above consisted in subjecting the hot board strand to shock cooling immediately after leaving the continuously operating press and carrying it through a double-belt holding apparatus whose holding belts exert a specific bearing pressure of no more than 0.05 N/mm$^2$ onto the surfaces of the board strand, and the backs of the holding belts are sprayed with an appropriate coolant as they run, the action of the shock cooling thus performed being continued until the temperature in the center of the board strand has reached approximately 80° to 100° Celsius.

The method accordingly consists in cooling the board strand very quickly in a double-belt holding apparatus immediately after leaving the hot press, by a kind of shock cooling. In the double-belt holding apparatus the surface temperature of the board strand is reduced from about 160° Celsius to about 30° Celsius. The center of the board must be cooled in the double-belt holding apparatus from 115° Celsius to 100° Celsius and less, preferably 80° Celsius.

The apparatus according to the German patent application above consisted in the fact that the cooling apparatus is arranged as a double-belt holding apparatus directly following the continuously operating press and is designed with an exerted holding pressure of up to a maximum of 0 to 0.05 N/mm$^2$ and a plurality of rows of coolant spray nozzles are disposed on the backs of the belt areas that are in contact with the board strand.

The present invention relates to a further development of the method described in the German patent application above and of the apparatus for the practice of the method. For it has been found that, during production, the belt run-out occurring in the continuously operating press causes a considerable belt run-out in the double-belt holding system. Furthermore, transporting a burst board strand through the double-belt holding system is problematical. Damage can be done thereby to the steel belts and in the double-belt holding system itself.

The present invention is addressed to the problem of presenting a method by which any belt and board strand run-out occurring in the double-belt holding apparatus will be prevented from propagating and causing damage therein, and to create an apparatus for the practice of the method.

SUMMARY OF THE INVENTION

The solution as to the method is that the hot board strand is divided into single boards of predetermined length immediately after leaving the continuously operating press and is then subjected to shock cooling while being carried by a double-belt holding apparatus whose holding belts exert a specific bearing pressure of 0.05 N/mm$^2$ on the surfaces of the single boards and the backs of the holding belts are sprayed with a suitable coolant as they pass, and the action of the shock cooling thus performed is applied until the temperature in the center of the single boards has reached approximately 80° Celsius to 100° Celsius.

The apparatus for the practice of the method includes a cooling apparatus in the form of a double-belt holding system with a maximum applicable holding pressure of 0 to 0.05 N/mm$^2$; and immediately following the continuously operating press and ahead of the cooling apparatus a diagonal sawing system is disposed for cutting the board strand into individual boards, and several rows of coolant spray nozzles are disposed on the backs of the holding belts making contact with the single boards.

The single boards thus severed cause no problems in regard to the belt run-out while being cooled in the double-belt holding apparatus, since they can be aligned absolutely by simple adjustment as they run along the loading and production axis.

It is also advantageous if the single boards, after being cut apart, pass through a quality checking apparatus, for example a burst detection or gap measuring device, and are carried over a weigh-scale, and rejected boards are removed from the production line by a board deflector ahead of the cooling process. It also saves energy to use in the double-belt holding system the fresh water from the chopper preheating system. In this manner the invested costs and the operating costs of a cooling tower for operating the cooling system in the double-belt holding apparatus can be saved.

By the use of the cooling system according to the invention, it becomes possible to polish in the production line, since polishing is possible only at a board surface temperature below 60° Celsius since otherwise the polishing belts become clogged. Due to the polishing operation it is possible to do without the intermediate supports such as those, for example, which are provided in MDF production.

Additional advantageous measures and embodiments of the subject matter of the invention will be found in the subordinate claims and in the following description with drawing.

BRIEF DESCRIPTION OF THE DRAWING

The drawing shows a side view of a press according to one preferred embodiment of the present invention.

DETAILED DESCRIPTION OF PREFERRED EMBODIMENT

The drawing shows the apparatus for the practice of the method, with the continuously operating press 1, consisting of two flexible endless steel belts 3 and 4 which take the mat of material between them and carry it through the continuously operating press 1, the steel belts 3 and 4 being circulated by drive drums 5 and idler drums (not shown) around a press table 7 and a press ram 8 and, with friction-reducing elements such as roller bars 9, thrust against heated press plates 10 and 11 of press table 7 and press ram 8. Immediately following the continuously operating press 1 a diagonal sawing apparatus 21 is provided for dividing the board strand 13 into single boards 24; the diagonal sawing apparatus 21 is also able to have two trim saws (not shown) trimming the longitudinal edges. The trimming could also be performed after the cooling. But it is preferably performed before the division into lengths as described above.

Reference numeral 22 represents a quality control apparatus from which a finding of "good" or "reject" causes the rejected board deflector 23 to pass the board on to the cooling system or down into the rejected board storage 25 or reprocessing storage. The quality control system 22 could include a burst detecting or burst measuring apparatus; it could also include a weigh scale or weighing apparatus. The cooling apparatus according to the invention is designed as a double-belt holding system 12 in which the holding belts 17 and 18 take the still-hot single boards 24 between them and guide them through the double-belt holding system 12. On the backs of the belts a plurality of rows of coolant spray nozzles 16 are arranged. The holding belts 17 and 18 circulate over drive rolls 14 and idler rolls 15 and thrust within the cooling system and double-belt holding system 12 against conveyor rolls 19. The low pressure against the holding belts 17 and 18 is produced by the air pressure introduced into the air-pressure boxes 20.

Accordingly, in one preferred embodiment, the present invention includes a method for the production of ligneous material boards, such as chipboards, fiber boards, plastic boards and flake boards as well as plastic boards made of combined portions of wood and plastic as well as plastic with and without strengthening inserts, in which a mat of material to which binding agent is added is formed on a continuously moving belt and, after introduction between the steel belts of a continuously operating hot press, is cured by the application of pressure and heat to form a board strand and then is exposed to a cooling system with low specific pressure, according to DE 199 19 822.5, characterized in that immediately after leaving the continuously operating press the hot board strand is divided into single boards of predetermined lengths and then is subjected to shock cooling while it is carried through a double-belt holding apparatus whose holding belts exert upon the surfaces of the single boards a specific contact pressure of maximum 0.05 $N/mm^2$ and the backs of the holding belts are sprayed as they run with an appropriate coolant, the active time of the shock cooling thus performed is exerted until the temperature in the center of the single boards has reached approximately 80° Celsius to 100° Celsius.

According to another preferred embodiment, the present invention includes an apparatus for the practice of the method for the production of ligneous material boards, such as chip boards, fiber boards, plastic boards and ligneous material boards in an endless board strand, with a continuously operating press, comprising two flexible endless steel belts which take the press material between them and carry them through the press, are carried by drive drums and pulley drums around a press table and a press ram 8, the steel belts resting in some cases with friction-reducing elements against heated press plates of press table and press ram and a cooling system that follows, characterized in that the cooling system is in the form of a double-belt holding apparatus (12) with an applied holding pressure of no more than 0 to 0.05 $N/mm^2$, and immediately behind the continuously operating press (1) and ahead of the cooling system, a diagonal sawing system (21) is disposed in order to divide the board strand (13) into single boards (24), and on the backs of the holding belts (17, 18) making contact with the single boards (24) several rows of coolant spray nozzles (16) are disposed.

The cooling system according to the invention can be applied to advantage also in apparatus involving cyclically, i.e., discontinuously, operating multistage presses (single or multiple stage presses), wherein separate mats 2 of the material to be pressed or already spread lengthwise are hardened. In that case the diagonal saw apparatus 21 following the pressing operation can be eliminated, unless smaller sizes than the press surface are required or this cut is performed in the stand.

The priority document here, German patent application 100 05 251.7 filed Feb. 6, 2000, is hereby incorporated by reference.

What is claimed is:

1. A method for the production of ligneous material boards, comprising the steps of:

curing a mat of material by the application of pressure and heat in a continuously operating hot press to form a board strand;

after leaving the continuously operating press, dividing in a sawing apparatus the hot board strand into single boards of predetermined lengths; and then subjecting a plurality of the single boards to shock cooling while they are carried through a double-belt holding apparatus having holding belts that exert upon surfaces of the single boards a specific contact pressure of maximum 0.05 $N/mm^2$, wherein backs of the holding belts are sprayed with coolant as they run, an active time of the shock cooling thus performed is continued until the temperature in the center of the single boards has reached approximately 80° Celsius to 100° Celsius.

2. The method according to claim 1, further comprising: after cutting the single boards to size, carrying the single boards through a quality control system, and to a weighing apparatus.

3. The method according to claim 2, further comprising removing from a production line before the cooling process at least one of the single boards classed as a reject.

4. The method according to claim 1, further comprising delivering cooling water heated in the double-belt holding apparatus to at least one of a preheating system and a preliminary steamer.

5. The method according to claim 1, further comprising at least one of polishing, lacquering, and coating the surfaces of the single boards immediately following the double-belt holding apparatus.

6. The method according to claims 1, further comprising trimming the single boards in the sawing apparatus.

7. A method for the production of ligneous material boards, comprising the steps of:

curing a mat of material by the application of pressure and heat cyclically in a multilayer hot press to form single boards; and then subjecting the single boards to shock cooling while they are carried through a double-belt holding apparatus having holding belts that exert upon surfaces of the single boards a specific contact pressure of maximum 0.05 $N/mm^2$, wherein backs of the holding belts are sprayed with coolant as they run, an active time of the shock cooling thus performed is continued until the temperature in the center of the single boards has reached approximately 80° Celsius to 100° Celsius.

* * * * *